US009051518B2

(12) United States Patent
Ng et al.

(10) Patent No.: US 9,051,518 B2
(45) Date of Patent: Jun. 9, 2015

(54) HIGH TEMPERATURE FROTH UNDERWASH IN AN OIL SAND BITUMEN EXTRACTION SEPARATION VESSEL

(75) Inventors: Yin Ming Samson Ng, Sherwood Park (CA); Wayne Benidect Jansen, Edmonton (CA); Kevin Liu, Fort McMurray (CA); Shao-Shan Tang, Calgary (CA)

(73) Assignee: SYNCRUDE CANADA LTD., Fort McMurray (CA), In trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 13/588,303

(22) Filed: Aug. 17, 2012

(65) Prior Publication Data

US 2014/0048451 A1 Feb. 20, 2014

(51) Int. Cl.
*C10G 1/04* (2006.01)
*F17D 1/00* (2006.01)

(52) U.S. Cl.
CPC . *C10G 1/045* (2013.01); *F17D 1/00* (2013.01)

(58) Field of Classification Search
CPC ..... C10G 1/04; C10G 1/045; B03D 1/1443; B03D 1/1493; B01D 21/0087; B01D 21/2405; F17D 1/00
USPC ..... 208/390, 391
See application file for complete search history.

(56) References Cited

U.S. PATENT DOCUMENTS

| | | | | |
|---|---|---|---|---|
| 3,520,415 | A | 7/1970 | Cymbalisty | |
| 3,565,785 | A * | 2/1971 | Cymbalisty | 208/391 |
| 3,567,621 | A | 3/1971 | Gray et al. | |
| 3,847,789 | A * | 11/1974 | Cymbalisty | 208/391 |
| 6,007,708 | A * | 12/1999 | Allcock et al. | 208/391 |
| 2007/0090025 | A1 * | 4/2007 | Strand | 208/391 |
| 2011/0062090 | A1 * | 3/2011 | Bara et al. | 210/801 |

OTHER PUBLICATIONS

Cymerman, G. J., et al. Energy Conservation Measures at Syncrude Oil Sand Processing Operations. CIM Conference and Exhibition, May 14-17, 2006. Vancouver, Canada.
Mankowski, P., et al. Syncrude's Low Energy Extraction Process: Commercial Implementation. Proceedings—31st Annual Meeting of the Canadian Mineral Processors. Jan. 20, 1999. pp. 152-181. Ottawa, Canada.

* cited by examiner

*Primary Examiner* — Prem C Singh
*Assistant Examiner* — Brandi M Doyle
(74) *Attorney, Agent, or Firm* — Bennett Jones LLP

(57) ABSTRACT

A process for enhancing the froth quality, improving vessel operability and increasing the froth temperature from an oil sand slurry in a primary separation vessel is provided, comprising introducing the oil sand slurry into a separation vessel; retaining the oil sand slurry within the separation vessel so that separate layers of bitumen froth, middlings and sand tailings are formed; introducing sufficient heated water having a temperature greater than about 80° C. as an evenly distributed underwash layer beneath the bitumen froth layer; and separately removing the bitumen froth, middlings and sand tailings from the separation vessel.

11 Claims, 6 Drawing Sheets

HIGH TEMPERATURE FROTH UNDERWASH IN AN OIL SAND BITUMEN EXTRACTION SEPARATION VESSEL

FIELD OF THE INVENTION

The present invention relates to a process and equipment for improving froth quality, in terms of water and solids content, from oil sand bitumen extraction, which are particularly useful when processing problem oil sand ores such as those that have higher fines content and/or lower bitumen grade. More particularly, conditioned oil sand slurry prepared from oil sand ore and/or problem ores is introduced into a bitumen separation vessel where hotter underwash water is injected to form a stable, hot underwash water layer between the bitumen froth and middlings.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules which contain a significant amount of sulfur, nitrogen and oxygen. Oil sand deposits are typically extracted by surface mining. The mined oil sand is trucked to crushing stations for size reduction, and fed into slurry preparation units such as tumblers, cyclofeeders, and the like where hot water and, optionally, caustic are added to form a slurry for bitumen separation. The oil sand slurry may be screened through a screening device, where additional hot water may be added to clean the rejects prior to delivery to a rejects pile. The (screened) oil sand slurry is collected in a vessel and then pumped through a hydrotransport pipeline designed to condition and carry oil sand slurry from mining to extraction facilities to ensure sufficient conditioning of the oil sand slurry. During the conditioning stage in the hydrotransport pipeline, the aeration of slurry occurred where bitumen is attached to air bubbles, creating a lower density bitumen-air aggregates.

The conditioned slurry is then fed to a primary separation vessel ("PSV"). In the PSV, the slurry is allowed to separate under quiescent conditions for a prescribed retention period into a top layer of bitumen froth, a middle layer of middlings (i.e., warm water, fines, residual bitumen), and a bottom layer of coarse tailings (i.e., warm water, coarse solids, residual bitumen).

The interface between the bitumen froth and middlings is well defined when processing ores which are relatively high in bitumen content and low in fines content. "Fines" are particles such as fine quartz and other heavy minerals, colloidal clay or silt generally having any dimension less than about 44 μM. "Good ores" are oil sand ores having high bitumen content (10-12%) and relatively low fines content (less than about 20%). In contrast, "poor ores" are oil sand ores having low bitumen content (7-10%) and relatively high fines content (greater than 30%).

Poor ores typically do not segregate properly. The problem of "sludging" in the PSV is triggered by high fines content, and is characterized by the deterioration of the interface between the bitumen froth and middlings due to an increase in the density of the middlings. Coarser mineral particles and bitumen become entrapped in the process slurry as a result of non-segregating settling. Such conditions result in lower bitumen recovery and poorer quality of bitumen froth, leading to a decrease bitumen production capacity through the froth treatment plant. Attempts to alleviate this problem include manipulating operation variables such as, for example, total water, caustic dosage, ore blending, and throughput. A further problem encountered with bitumen froth quality is low froth temperature as a result of reducing the bulk processing temperature. Hence, this may lead to production capacity restrictions in downstream froth heating equipment.

SUMMARY OF THE INVENTION

The current application is directed to a process and apparatus for separating solids and bitumen from a conditioned oil sand slurry. The present invention is particularly useful with, but not limited to, problem ores, for example, ores having high amounts of fine solids which may interfere in bitumen separation, froth treatment, and tailings management. It was surprisingly discovered that by introducing a hotter underwash layer into a primary separation vessel at a controlled rate, the underwash water layer remained intact, with a steady-state thickness of water layer maintained between the upper froth layer and the lower middlings zone. One or more of the following benefits may be realized as direct results of the hot underwash layer:

(1) producing a more distinct interface between bitumen froth and middlings when controlling the feed rate of underwash relative to the feed rate of oil sand slurry, thereby resulting in better separation of bitumen froth from solids and water and also enhanced operability of the primary separation vessel as a result of clean water layer formed between froth and middlings layers;

(2) enhancing the froth quality by reducing water and solids content while increasing the bitumen content, (3) providing additional heat to the bitumen froth via an underwash layer may sufficiently increase the froth temperature such that less hot water may be required as compared to conventional practices of heating the entire oil sand slurry by dilution with hot water (flood water) prior to slurry addition to the separation vessel;

(4) higher froth temperature may result in better deaeration of the bitumen froth, which is generally required prior to most conventional bitumen froth treatments; and (5) conventional froth treatment processes which use centrifuges and inclined plate settlers are generally performed at 80° C.; however, when practicing the present invention, the froth may already be sufficiently heated for subsequent froth treatment.

Thus, use of the present invention allows for the redistribution of energy input into the bitumen recovery process from mined oil sand, thus, allowing for energy savings.

In one aspect, a process for removing solids and water from bitumen froth produced from an oil sand slurry is provided, comprising:

- introducing the oil sand slurry into a separation vessel;
- retaining the oil sand slurry within the separation vessel so that separate layers of bitumen froth, middlings and sand tailings are formed;
- introducing sufficient heated water having a temperature greater than about 80° C. as an evenly distributed underwash layer beneath the bitumen froth layer; and
- separately removing the bitumen froth, middlings and sand tailings from the separation vessel.

In one embodiment, the heated water is at a temperature between about 80° C. and about 94° C. In another embodiment, the heated water is at a temperature greater than about 94° C. In one embodiment, the heated water is introduced into the separation vessel at a water to oil sand feed ratio of about 0.04:1 to about 0.1:1. It was surprisingly discovered that if the underwash is introduced at too low of an underwash to oil sand feed ratio, i.e., less than about 0.04:1, a complete underwash layer would not be formed. Increasing the ratio resulted in an increase in the thickness of the water layer between the bitumen froth and middlings, which would provide higher quality froth, i.e., lower solids.

In another aspect, an underwash injection assembly for use in a separation vessel for evenly distributing an underwash layer into the vessel is provided, comprising:

a main header having a flow meter for supplying heated water having a temperature of at least about 80° C. to an underwash distributor system which distributes the heated water to a number of manifolds connected to an outer ring header and a number of manifolds connected to an inner ring header; and a downcomer connected to each manifold with substantially equal lengths of tubing.

In one embodiment, the tubing comprises flexible tubing. In another embodiment, the outer ring comprises 24 manifolds and the inner ring comprises 14 manifolds.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DETAILED DESCRIPTION OF THE PREFERRED EMBODIMENTS

Figure 1:
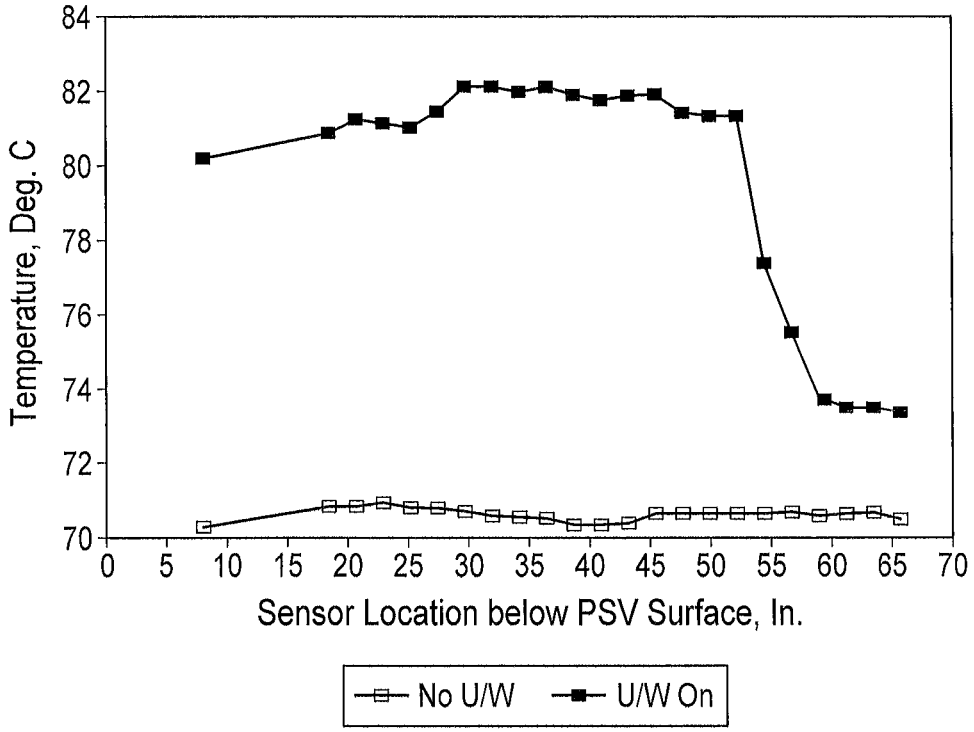
FIG. 1 is a graph comparing froth temperature with and without injection of hot underwash water.

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a process and equipment for improving extraction froth product quality from problem oil sand ores such as those that have higher fines content and/or lower bitumen grade. The quality of bitumen froth is determined not only by the relative amounts of water and solids present in the material, but also by the ease with which such components can be separated from the froth within the bitumen separation vessel (PSV).

A conventional PSV generally defines a separation chamber having a cylindrical upper portion and a conical lower portion. The upper portion comprises a feedwell having an inlet through which the conditioned slurry enters the PSV at the upper portion of the separation chamber. The inlet is generally oriented tangential to the upper portion, thereby generating a swirling flow when feeding the slurry into the separation chamber. The PSV is generally equipped with a rake rotatably mounted within the lower portion of the PSV to rake the slurry slowly in a downward motion, thereby aiding in the separation process.

The PSV includes an underwash water distributor which introduces stable underwash water beneath the layer of bitumen froth. As used herein, the term "underwash water" means relatively clean heated water which is used to warm the froth. Since the specific gravity of water (1) lies between the specific gravities of froth (0.6-0.9) and middlings (1.1-1.4), a water layer can be maintained between the froth and middlings. The ascending aerated bitumen droplets thus passes immediately through a layer of hot underwash water before joining the froth, enhancing froth quality by washing rising aerated bitumen droplets and maintaining a mild downward current which depresses the fines to the middlings, thereby reducing the solids content entrained to the froth layer. Further, if the temperature of the water layer is higher than that of the middlings, the bitumen droplets rising through the water layer are heated, resulting in a higher froth temperature. In turn, a higher froth temperature reduces bitumen viscosity and allows the formation of a tighter froth with less water and solids.

In one aspect, the present invention relates to a process of introducing conditioned oil sand slurry prepared from problem ores into a bitumen separation vessel and having an improved underwash water distribution assembly which evenly injects and distributes hotter underwash water to form a stable, hot underwash water layer between the bitumen froth and middlings.

The process involves injecting a sufficient amount of underwash water having a temperature greater than about 80° C., preferably about 94° C. or greater, beneath the bitumen froth but above the middlings. The exit velocity of the underwash water should be less than 1 ft/s to minimize the turbulence in the vessel that will disrupt the formation of a stable water layer. In one embodiment, the underwash water comprises tumbler water used in the "hot water process," whereby the as-mined oil sand is mixed in a tumbler with hot water (approximately 80-90° C.), caustic and naturally entrained air to yield the slurry that is later conditioned. Sufficient amounts of tumbler water and flood or dilution water may also be mixed together to yield an underwash water having a temperature of at least about 80° C., preferably about 94° C. or greater.

As described in the Examples, the use of hotter underwash water contributes to higher froth temperature, better froth quality in terms of lower froth water and solids content, better separation, vessel control and operability, and operation of the bitumen separation vessel at a lower temperature by using lower temperature flood water.

Once formed, the underwash water layer between the froth and middlings can be maintained unless disrupted by turbulence. If excessive turbulence is present, the water layer may disintegrate or necessitate additional injection of underwash water. Baffles are commonly included in bitumen separation vessels, as described in U.S. Pat. No. 3,520,415 to Cymbalisty and U.S. Pat. No. 3,567,621 to Gray et al. to reduce turbulence and to create a disengaging zone to minimize entrainment of solids in the froth layer. As used herein, the term "baffle" refers to a static flow-directing or obstructing vane or panel. Using the present invention with the exit velocity of <1 ft/s at the underwash discharge ports, it was found that a stable underwash water layer can be formed between the froth and middlings in a bitumen separation vessel without baffles.

The stability of the underwash water layer may be further improved by evenly injecting and distributing the hotter underwash water between the froth and middlings. In one aspect, the present invention relates to an improved underwash water distributor or injection assembly for optimizing the distribution of underwash water beneath the froth and middlings to form the stable water layer. In one embodiment, the injection assembly comprises an inner ring header and an outer ring header which are installed on the roof of the bitumen separation vessel. The inner ring header has a smaller diameter than that of the outer ring header. Both the inner and outer ring headers feed underwash water into injection conduits equidistantly spaced in relation to adjacent conduits, and extending below the PSV interface level.

Each injection conduit comprises an upper portion and a lower portion, and defines a bore extending therethrough between its ends to allow underwash water to flow downward from the respective inner ring or outer ring header. The upper portion has a diameter greater than that of the lower portion. A horizontal, annular shoulder is thus formed by the injection conduit at the junction of the upper and lower portions, and enlarges the area of the injection conduit to reduce the speed of the underwash water flow to <1 ft/s, thereby reducing turbulence at the discharge. The injection conduits may be constructed from any suitable piping as is employed in the art. Suitable piping includes, without limitation, plastic piping, galvanized metal piping, and stainless steel piping.

A deflector plate is connected to the end of the injection conduit by fastening bars to define a gap between the deflector plate and the end of the injection conduit. In one embodiment, the deflector plate is circular-shaped to deflect the water flow horizontally in all directions, and to prevent excessive dilution of the underwash water with the middlings.

The flow of underwash water through each injection conduit may be equalized by positioning a restriction orifice within the bore of the injection conduit. In one embodiment, the restriction orifice comprises a plate defining a central opening. Upon reaching the orifice plate, the underwash water is forced to converge to pass through the opening, resulting in velocity and pressure changes.

The flow of underwash water through each injection conduit may also be equalized by using valves. In one embodiment, each of the inner and outer ring headers comprises a pair of semi-circular portions having inlets at both ends. The inlets have associated valves which may be opened and closed to control the flow of the underwash water. The valves may comprise any suitable valve employed by those skilled in the art to permit, or prevent, the flow of the underwash water through an injection conduit. Suitable valves include, but are not limited to, butterfly valves, gate valves, and ball valves. In another embodiment, the design uses an equal length of flexible hose to connect the header to each downcomer. Therefore, each downcomer would have similar resistance and achieve a more hydraulic balance system to ensure equal water distribution. This design then eliminates the use of orifice and prevent plugging issues.

Figure 4:
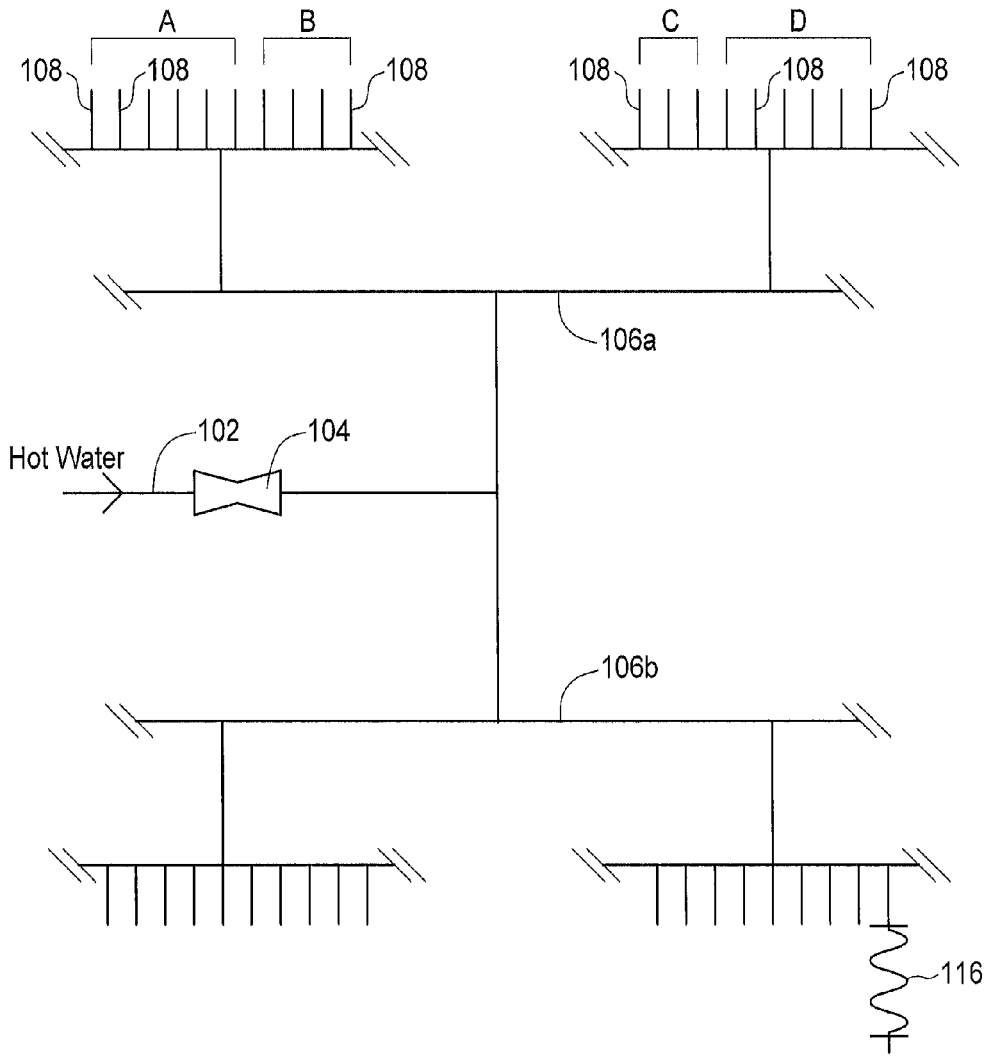
FIG. 4 is a schematic of an underwash distribution system useful for distributing heated water in a underwash distribution assembly of the present invention.
Figure 5:
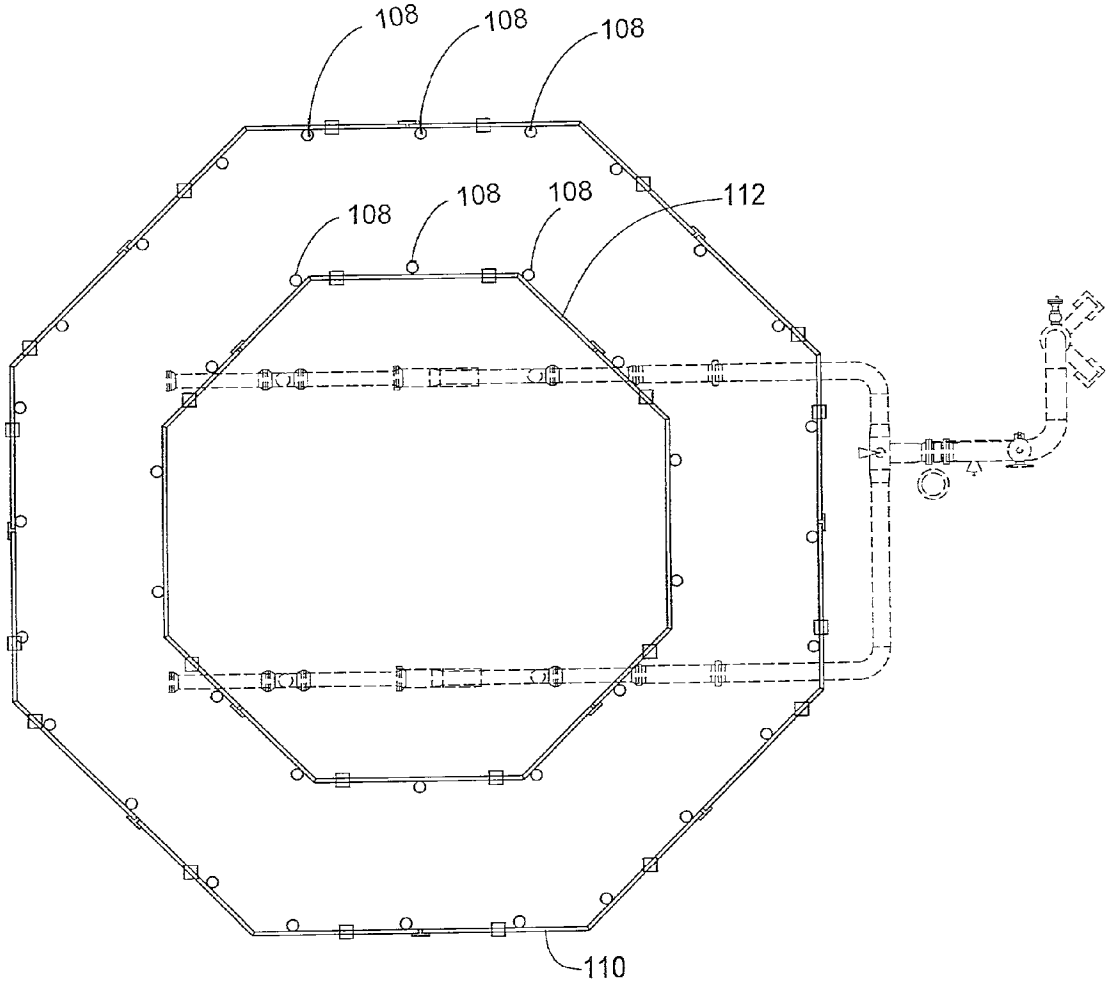
FIG. 5 is a schematic showing the inner and outer rings of the underwash distribution assembly of the present invention.
Figure 6:
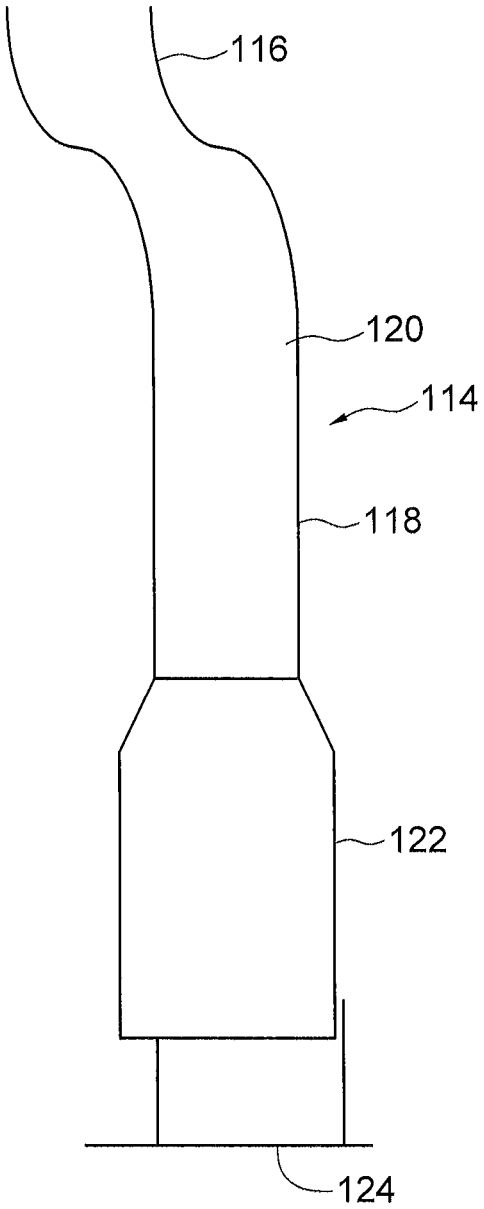
FIG. 6 is a schematic of a single downcomer of the underwash distribution assembly of the present invention.

An embodiment of an underwash water distribution assembly useful in the present invention is shown in FIGS. 4-6. In this embodiment, the froth underwash water distribution assembly utilizes a cascade froth underwash distributor system as shown in FIG. 4. In this embodiment, all branches of the distribution system are designed to have equal hydraulic resistance, so that the flow is naturally split equally among them, without requirement for flow control by valves or orifices. Hot water is delivered to the main header 102 (e.g., 12 inch diameter pipe) with flow rate controlled by venture flow meter 104. The water is divided into two (2) 10 inch headers 106*a*, 106*b* and each secondary header 106*a*, 106*b* supplies hot underwash water to half of the separation vessel (e.g., a PSV). For each secondary header 106*a*, 106*b*, there are nineteen (19) manifolds 108, with twelve (12) manifolds 108 (A+D) for the outer ring 110 (shown in FIG. 5) and seven (7) manifolds 108 (B+C) for the inner ring 112 (shown in FIG. 5). Therefore, there are nineteen (19) manifolds 108 for each half of the PSV with a total of thirty-eight (38) manifolds 108 for the entire PSV.

Each manifold 108 is connected to a downcomer through equal length of flexible hose 116, which preferably is ~30 ft. A schematic of a downcomer 114 useful in the present invention is shown in FIG. 6. In this embodiment, each downcomer 114 consists of a pipe 118 connecting to the flexible hose 116 and ending approximately 18" below a typical PSV interface level. The top portion 120 of the pipe is 2 inches in diameter. The bottom portion 122, which is 1.5 ft in length, has a diameter of 4 inch. A 6 inch circular deflector plate 124 is welded to the bottom with three rods, allowing for a 3" gap between the deflector plate 124 and the end of the 4" pipe. The purpose of the pipe expansion from 2" to 4" is to reduce the speed of the water flow, thus reducing the turbulence at the discharge. The downward velocity of the underwash water exiting the pipe is ~1 ft/s. The deflector plate is installed to deflect the water flow and prevent excessive underwash water dilution with the middlings' layer.

Exemplary embodiments of the present invention are described in the following Examples, which are set forth to aid in the understanding of the invention, and should not be construed to limit in any way the scope of the invention as defined in the claims which follow thereafter.

Example 1

Tests were conducted to assess the formation of a stable underwash water layer between the froth and middlings within a bitumen separation vessel without baffles. The horizontal fluid velocity at the PSV interface was estimated to be in the range of 0.7 to 1.5 ft/s. In one test, cold water was used as a tracer and confirmed that a stable underwash water layer formed between the froth and middlings.

In a further test, the temperature of the froth was sampled at different vertical distances (inches) below the surface of the separation vessel following injection of underwash water ("U/W on") having a temperature of 94° C. The test results indicate that the froth temperature ranged from about 80-83° C. between about 7"-53" below the surface of the separation vessel (FIG. 1). The froth temperature dropped to about 73° C. between about 55" to 60" below the surface of the separation vessel. Without injection of underwash water ("no U/W"), the froth temperature was about 71° C., which remained relatively constant at the PSV slurry temperature. Without being bound by theory, it is expected that the use of hotter underwash water allows the bitumen separation to occur at a lower temperature, but will not have any effect on the froth temperature as the bitumen-air aggregates rising through the hot underwash water layer will be heated.

Example 2

Figure 2:
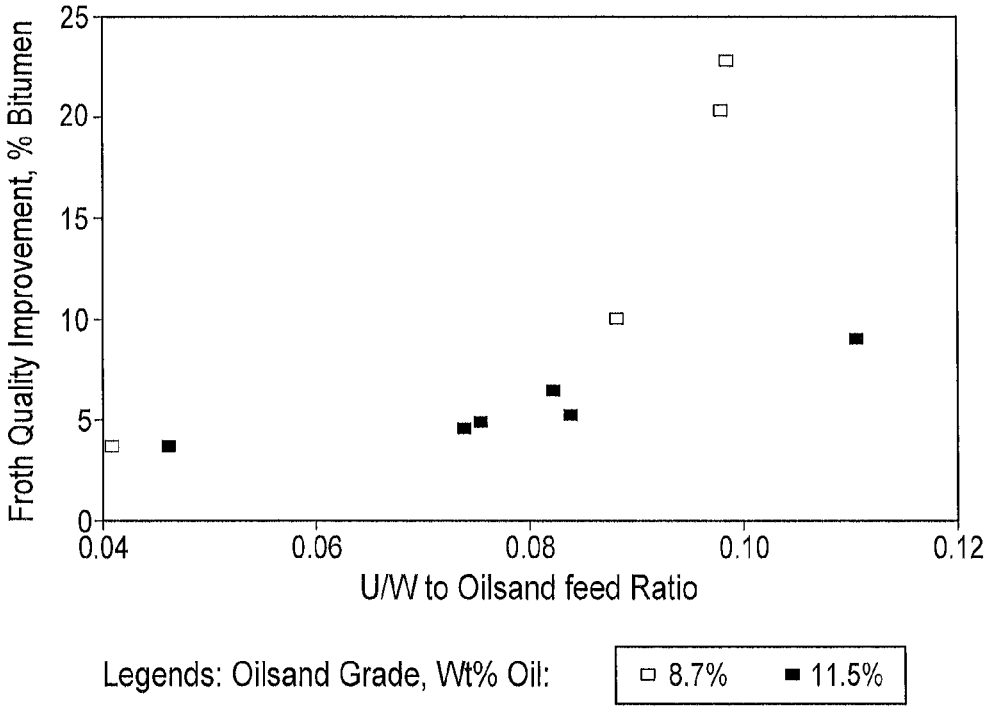
FIG. 2 is a graph comparing improvements in froth quality using an oil sand ore of 8.7 wt % in bitumen grade and 38 wt % in fines solids, and an oil sand ore of 11.5 wt % bitumen grade and 19 wt % in fines solids, at different underwash water:oil sand feed ratios.

Testing was conducted using an oil sand ore of 8.7 wt % in bitumen grade and 38 wt % in fines solids, an oil sand ore of 11.5 wt % in bitumen grade and 19 wt % in fines solids, and underwash water having different temperatures to test the effect of temperature and the underwash water to oil sand feed ratio on froth quality. The froth bitumen content increased by a maximum of 23% using an underwash water:ore feed ratio of 0.10 for the 8.7% grade oil sand, and by a maximum of 9% using an underwash water:ore feed ratio of 0.11 for the 11.5% grade oil sand at the underwash water temperature of 94° C. (FIG. 2). The underwash water temperature had more impact on froth bitumen enrichment for the "poor" oil sands than for the "good" oil sands. The test results are summarized in Table 1 below.

TABLE 1

| Average Grade (%) | Average Fines (%) | U/W Water Temperature (° C.) | U/W Water to Ore Feed Ratio | Froth Quality Bitumen (%) | Water (%) | Solids (%) |
|---|---|---|---|---|---|---|
| 11.5 | 19 | 65 | 0.076 | 64.39 | 25.27 | 10.34 |
| | | 94 | 0.075 | 63.91 | 25.80 | 10.29 |
| | | 94 | 0.074 | 63.61 | 25.77 | 10.62 |
| | | 94 | 0.046 | 62.61 | 27.50 | 9.89 |
| | | 94 | 0.084 | 64.28 | 26.77 | 8.95 |
| | | N/A | 0.000 | 58.95 | 31.77 | 9.28 |
| 8.7 | 38 | N/A | 0.000 | 37.25 | 48.59 | 14.16 |
| | | 94 | 0.099 | 59.81 | 33.12 | 7.07 |
| | | 94 | 0.098 | 57.28 | 35.73 | 6.99 |
| | | 56 | 0.099 | 52.14 | 40.00 | 7.86 |
| | | 80 | 0.096 | 55.92 | 36.48 | 7.60 |
| | | 80 | 0.052 | 58.45 | 34.26 | 7.29 |
| | | 80 | 0.073 | 53.78 | 38.62 | 7.60 |
| | | N/A | 0.000 | 36.66 | 50.92 | 12.42 |

By comparing conditions with and without froth underwash water, the average reductions (%) in the water:bitumen ratio and the solids:bitumen ratio were calculated. Solids reduction included all size ranges including solids below 20 μm. The test results are summarized in Table 2 below. Again, the use of underwash has water to bitumen and solids to bitumen ratios reduction higher for the "poor" ores than for the "good" ores.

TABLE 2

| Oil Sand Grade (wt % Bitumen) | Average Reduction (%) Water to bitumen ratio | Solids to bitumen ratio |
|---|---|---|
| 8.7 | 54 | 62 |
| 11.5 | 28 | 17 |

Figure 3:
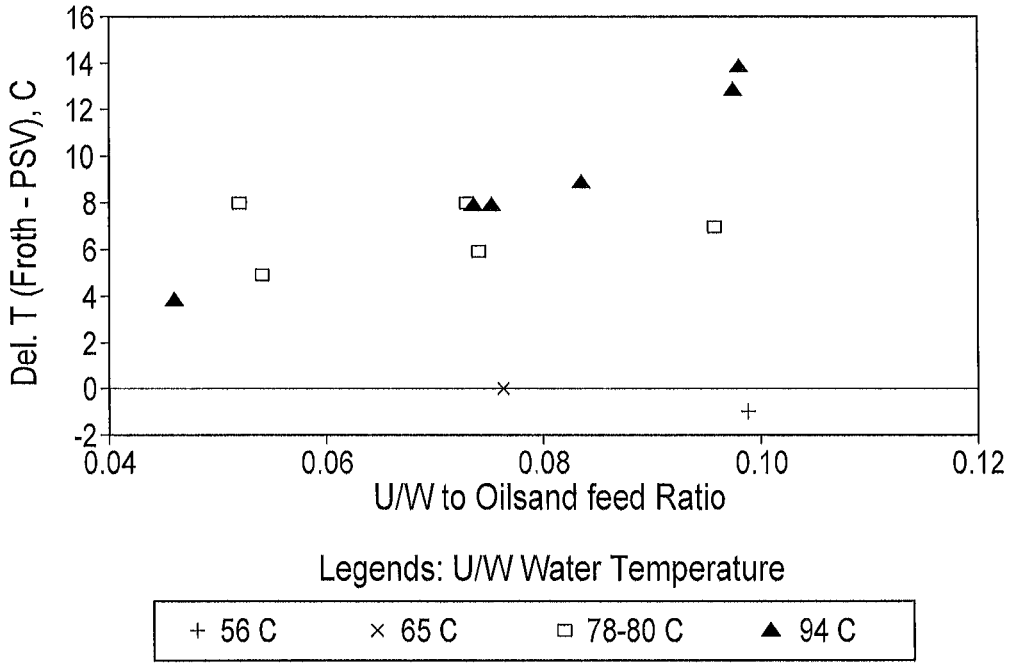
FIG. 3 is a graph showing the effect of different temperatures of underwash water on froth temperature at different underwash water:oil sand feed ratios.

The effect of different temperatures of underwash water on froth temperature at different underwash water:oil sand feed ratios was also determined. A maximum increase of 14° C. in froth temperature was achieved using underwash water having a temperature of 94° C. and an underwash water:ore feed ratio of 0.10 (FIG. 3). The test results are summarized in Table 3 below.

TABLE 3

| Average Grade (%) | Average Fines (%) | U/W Water to Ore Feed Ratio | U/W Water Temperature (° C.) | Froth Bitumen Content Enhancement (%) |
|---|---|---|---|---|
| 11.5 | 19 | 0.075 | 94 | 4.8 |
| | | 0.076 | 65 | 5.4 |

TABLE 3-continued

| Average Grade (%) | Average Fines (%) | U/W Water to Ore Feed Ratio | U/W Water Temperature (° C.) | Froth Bitumen Content Enhancement (%) |
|---|---|---|---|---|
| 8.7 | 38 | 0.10 | 94 | 21.6 |
| | | 0.10 | 80 | 19.0 |
| | | 0.10 | 56 | 15.2 |

Overall, the results clearly show a significant improvement in froth quality when hotter underwash water (94° C.) was used, in particular, for the "poor" ores.

Example 3

A field test was conducted to assess the ability of a modified underwash water distributor to form a stable water layer between the froth and middlings. The water addition pipes were spaced at 8' to 10' apart, and oriented below inner and outer ring headers installed on the roof of the bitumen separation vessel. The smaller inner ring header fed fourteen injection points, while the larger outer ring header fed twenty-four injection points. Equal length of flexible hose is used to connect the header to each downcomer, hence each downcomer will have equal hydraulic resistance to ensure equal water distribution. Each injection point consisted of pipe originating from the header and ending 18" below a typical PSV interface level. The top portion of the pipe was 2" in diameter, while the bottom portion was 1.5° in length and 4" in diameter. A 6" circular deflector plate was welded to the bottom of the pipe by three rods, allowing for a 3" gap between the deflector plate and the end of the 4" pipe. The downward velocity of the underwash water exiting the pipe was about 1 ft/s. A stable underwash water layer was observed between the froth and middlings.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A process for producing a bitumen froth having reduced solids and water from an oil sand slurry, comprising:

a) introducing the oil sand slurry into a separation vessel operated under quiescent conditions;

b) retaining the oil sand slurry within the separation vessel so that separate layers of bitumen froth, middlings and sand tailings are formed;

c) introducing sufficient heated water having a temperature greater than about 80° C. and forming a stable, evenly distributed underwash layer between the bitumen froth layer and the middlings; and d) separately removing the bitumen froth, middlings and sand tailings from the separation vessel;

wherein the heated water is introduced into the vessel at a heated water to oil sand ratio of about 0.04:1 to about 0.1:1 by weight.

2. The process of claim 1, wherein the heated water has a temperature between about 80° C. and about 94° C.

3. The process of claim 1, wherein the heated water has a temperature of at least about 94° C. or greater.

4. The process of claim 1, wherein the heated water is introduced into the vessel at a heated water to oil sand ratio of about 0.1:1 by weight.

5. The process of claim 1, comprising introducing the heated water through an injection assembly associated with the separation vessel.

6. The process of claim 5, wherein the injection assembly comprises an inner ring header and an outer ring header, each of the headers capable of distributing the heated water to downwardly extending conduits.

7. The process of claim 6, wherein each of the inner and outer ring headers comprises a pair of semi-circular portions having inlets and control valves.

8. The process of claim 7, wherein each conduit comprises an upper portion and a lower portion, the upper portion having a diameter greater than the diameter of the lower portion.

9. The process of claim 8, wherein each conduit comprises a restriction orifice.

10. The process of claim 9, wherein a deflector plate is connected to the end of each conduit by fastening bars to define a gap between the deflector plate and the end of the conduit so that the exit velocity of the water at the injection port is about 1 ft/sec or less to maintain stable underwash layer.

11. The process of claim 10, wherein the deflector plate is circular-shaped.

* * * * *